US008955961B2

(12) United States Patent
Ota et al.

(10) Patent No.: US 8,955,961 B2
(45) Date of Patent: Feb. 17, 2015

(54) PLATEN AND IMAGE RECORDING APPARATUS

(75) Inventors: Yasuhira Ota, Yatomi (JP); Iwane Sano, Obu (JP); Shingo Ito, Kasugai (JP); Naokazu Tanahashi, Nagoya (JP); Masao Mimoto, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 494 days.

(21) Appl. No.: 13/308,365

(22) Filed: Nov. 30, 2011

(65) Prior Publication Data

US 2012/0134733 A1 May 31, 2012

(30) Foreign Application Priority Data

Nov. 30, 2010 (JP) ..... 2010-266616
Nov. 30, 2010 (JP) ..... 2010-266619

(51) Int. Cl.

| | |
|---|---|
| ***B41J 2/01*** | (2006.01) |
| ***B41J 11/06*** | (2006.01) |
| ***B41J 11/00*** | (2006.01) |
| *B41J 11/057* | (2006.01) |
| *B41J 11/02* | (2006.01) |

(52) U.S. Cl.

CPC ..... *B41J 11/06* (2013.01); *B41J 11/0065* (2013.01); *B41J 11/057* (2013.01); *B41J 11/02* (2013.01)

USPC ..... 347/104; 347/101

(58) Field of Classification Search

CPC ..... B41J 11/02; B41J 11/057
USPC ..... 347/104, 101, 84, 90, 35, 36
See application file for complete search history.

(56) References Cited

U.S. PATENT DOCUMENTS

| | | | | |
|---|---|---|---|---|
| 6,964,466 | B1 | 11/2005 | Kodama et al. | |
| 2002/0089564 | A1 * | 7/2002 | Ohashi | 347/41 |
| 2004/0239742 | A1 * | 12/2004 | Hiraki et al. | 347/104 |
| 2005/0095046 | A1 * | 5/2005 | Beehler | 400/23 |
| 2005/0195262 | A1 * | 9/2005 | Takeda et al. | 347/103 |
| 2006/0023052 | A1 * | 2/2006 | Watanabe et al. | 347/104 |
| 2006/0103711 | A1 * | 5/2006 | Kodama et al. | 347/104 |
| 2007/0064078 | A1 * | 3/2007 | Nishi et al. | 347/104 |
| 2008/0238994 | A1 * | 10/2008 | Ota | 347/36 |

(Continued)

FOREIGN PATENT DOCUMENTS

| | | | |
|---|---|---|---|
| JP | 2006247884 | A * | 9/2006 |
| JP | 2008-246836 | A | 10/2008 |

(Continued)

OTHER PUBLICATIONS

Notice of Reasons for Rejection in Japanese Office Action issued in JP 2010-266619, mailed Feb. 18, 2014.

(Continued)

*Primary Examiner* — Laura Martin
*Assistant Examiner* — Leonard S Liang
(74) *Attorney, Agent, or Firm* — Merchant & Gould PC

(57) ABSTRACT

A platen, which supports the recording paper to be transported, includes a first portion having an upper surface on which an ink discharged from nozzles disposed thereover can be landed, first ribs which are provided to extend in a transport direction in an area of the upper surface and which support the recording paper on an upper side beyond the upper surface, and a second portion which is provided on at least one of an upstream side and a downstream side of the first portion.

20 Claims, 11 Drawing Sheets

(56) References Cited

U.S. PATENT DOCUMENTS

| | | | | |
|---|---|---|---|---|
| 2009/0244175 | A1* | 10/2009 | Kojima | 347/33 |
| 2010/0220165 | A1* | 9/2010 | Maekawa et al. | 347/104 |
| 2012/0320129 | A1* | 12/2012 | Kawakami et al. | 347/44 |
| 2012/0327160 | A1* | 12/2012 | Yamamoto | 347/44 |

FOREIGN PATENT DOCUMENTS

| | | | | |
|---|---|---|---|---|
| JP | 2009-208245 | A | | 9/2009 |
| JP | 2010-012599 | A | | 1/2010 |
| JP | 2010-228460 | A | | 10/2010 |
| JP | 2011121291 | A | * | 6/2011 |

OTHER PUBLICATIONS

Notice of Reasons for Rejection in Japanese Office Action issued in JP 2010-266616, mailed Feb. 18, 2014.

* cited by examiner

PLATEN AND IMAGE RECORDING APPARATUS

CROSS REFERENCE TO RELATED APPLICATION

The present application claims priority from Japanese Patent Applications No. 2010-266616 filed on Nov. 30, 2010 and No. 2010-266619 filed on Nov. 30, 2010 the disclosures of which are incorporated herein by reference in its entirety.

BACKGROUND OF THE INVENTION

1. Field of the Invention

The present invention relates to a platen which is arranged opposingly to a recording head under or below the recording head having nozzles capable of discharging ink droplets and which supports a recording medium transported in a transport direction, and an image recording apparatus which is provided with the platen.

2. Description of the Related Art

An image recording apparatus, which is based on the ink jet recording system, discharges ink droplets to a recording medium from nozzles provided on a recording head. Accordingly, an image is recorded on the recording medium supported by a platen provided opposingly to the recording head.

When the so-called borderless print, in which an image is recorded on a recording medium without providing any blank space or margin, is performed by using the image recording apparatus, the ink is also discharged to an area slightly protruding to the outside of the recording medium, in addition to a recording area for the image (area in which the recording medium supported by the platen is present). As a result, the ink, which is not landed on the recording medium, is adhered to the platen. In this situation, the ink adheres to a back surface of a recording medium which is transported subsequently and which is supported by the platen, and the back surface of the recording medium is dirtied.

In order to avoid this inconvenience, for example, a platen, which is described in Japanese Patent Application Laid-open No. 2009-208245, has internal area support ribs which are provided in a recording area in which the ink is landed in the borderless print. Accordingly, a recording medium is supported by the internal area support ribs in the recording area. Therefore, it is possible to prevent the back surface of the recording medium from being dirtied by the ink.

SUMMARY OF THE INVENTION

In the case of the platen described in Japanese Patent Application Laid-open No. 2009-208245, the internal area support ribs are formed in a state of being connected to an upstream side support portion provided on the upstream side of the recording area. Therefore, it is feared that the ink, which is landed in the vicinity of a boundary portion between the internal area support rib and the upstream side support portion in the recording area, may be moved from the internal area support rib to the upstream side support portion in accordance with the capillary phenomenon. As a result, the upstream side support portion, on which the ink is not landed in the ordinary situation, is dirtied by the ink.

The present invention has been made taking the foregoing problem into consideration, an object of which is to provide a structure which makes it possible to lower such a possibility that a back surface of a recording medium may be dirtied by an ink, even when the borderless print is executed on the recording medium in accordance with the ink-jet recording system.

According to an aspect of the present invention, there is provided a platen which supports a recording medium transported in a transport direction and which is arranged opposingly under a recording head having nozzles through which droplets of an ink are discharged, the platen including:

a first portion which is formed with a landing surface on which the ink discharged from the nozzles is landed;

a first rib which extends in the transport direction in a predetermined area including the landing surface, which protrudes to an upper side beyond the landing surface, and which supports the recording medium; and a second portion which is provided on at least one of an upstream side and a downstream side in the transport direction as compared with the first portion and which supports the recording medium.

In this case, since the first rib which protrudes to the upper side beyond the landing surface and a second portion support the recording medium, it possible to lower such a possibility that a back surface of the recording medium may be dirtied by an ink, even when the borderless print is executed on the recording medium.

In the platen of the present invention, a recess, which has a bottom surface that is lower than an upper surface of the second portion, may be formed at a boundary portion with respect to the second portion, on an upper end of at least one of the first ribs.

According to this arrangement, the ink, which is landed in the vicinity of the boundary portion between the first rib and the second portion, stays in the recess. Accordingly, the distance of upward movement, which is required for the ink to arrive at the second portion from the recess in accordance with the capillary phenomenon, is prolonged or lengthened. Therefore, it is possible to lower such a possibility that the ink may be moved from the first rib to the second portion in accordance with the capillary phenomenon.

In the platen of the present invention, the first portion may be formed as a plurality of ink-receiving portions which are arranged while providing spacings in a widthwise direction that is perpendicular to the transport direction and that extends along the landing surfaces, the second portion may include an upstream side support portion which is provided on an upstream side in the transport direction as compared with the ink-receiving portions and which supports the recording medium, and a downstream side support portion which is provided on a downstream side in the transport direction as compared with the ink-receiving portions and which supports the recording medium; and the first rib which is separated from the ink-receiving portions in the widthwise direction in relation to at least one of spacings, which is provided to extend between the upstream side support portion and the downstream side support portion in the transport direction, which protrudes to the upper side beyond the landing surface, and which supports the recording medium.

According to this arrangement, the first rib is formed in at least one of the spacings between the ink-receiving portions, and the first rib is separated from the ink-receiving portions. Therefore, even when the borderless print is repeatedly executed, and the total amount of the ink adhered to the landing surface is increased, then it is possible to prevent the ink from being transferred to the first rib. Therefore, it is possible to prevent the ink from being transferred to the top of the first rib in accordance with the capillary phenomenon.

BRIEF DESCRIPTION OF THE DRAWINGS

FIG. 7 shows vertical sectional views illustrating the platen 42, wherein

FIG. 9 shows front views and a left side view illustrating recesses 34, wherein

DESCRIPTION OF THE PREFERRED EMBODIMENTS

Figure 1:
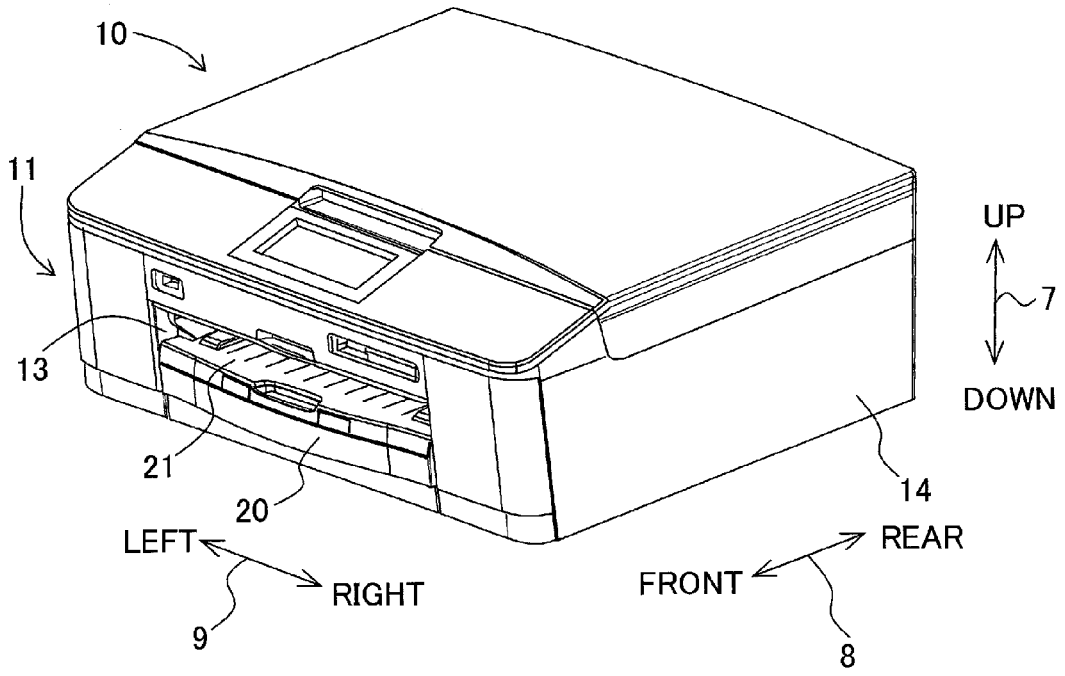
FIG. 1 shows a perspective view illustrating an appearance of a multifunction machine 10 as an exemplary embodiment according to the present invention.

An embodiment of the present invention will be explained below. The embodiment explained below is merely an example of the present invention. It goes without saying that the embodiment of the present invention can be appropriately changed within a scope without changing the gist or essential characteristics of the present invention. In the following description, the advance, which is directed from the start point to the end point while considering the arrow in relation to the vector, is expressed as the orientation, and the movement, which is brought about on the line to connect the start point and the end point without considering the arrow in relation to the vector, is expressed as the direction. In the following explanation, the up-down direction 7 is defined on the basis of the state (state shown in FIG. 1) in which a multifunction machine 10 is installed usably, the front-rear direction 8 is defined assuming that the side, on which an opening 13 is provided, is designated as the front side (front surface), and the left-right direction 9 is defined while viewing the multifunction machine 10 from the front side (front surface).

<Multifunction Machine 10>

As shown in FIG. 1, the multifunction machine 10, which is an example of the image recording apparatus of the present invention, is generally formed to have a thin type rectangular parallelepiped shape. A printer section 11, which is based on the ink-jet recording system, is provided at a lower portion. The multifunction machine 10 has various functions including, for example, the facsimile function and the print function. The printer section 11 has a casing 14 which has the opening 13 formed on the front surface. A paper feed tray 20 and a paper discharge tray 21 can be inserted/extracted (installed/removed) in the front-rear direction 8 into/from the opening 13. The recording paper (example of the recording medium of the present invention) having a desired size is placed on the paper feed tray 20.

Figure 2:
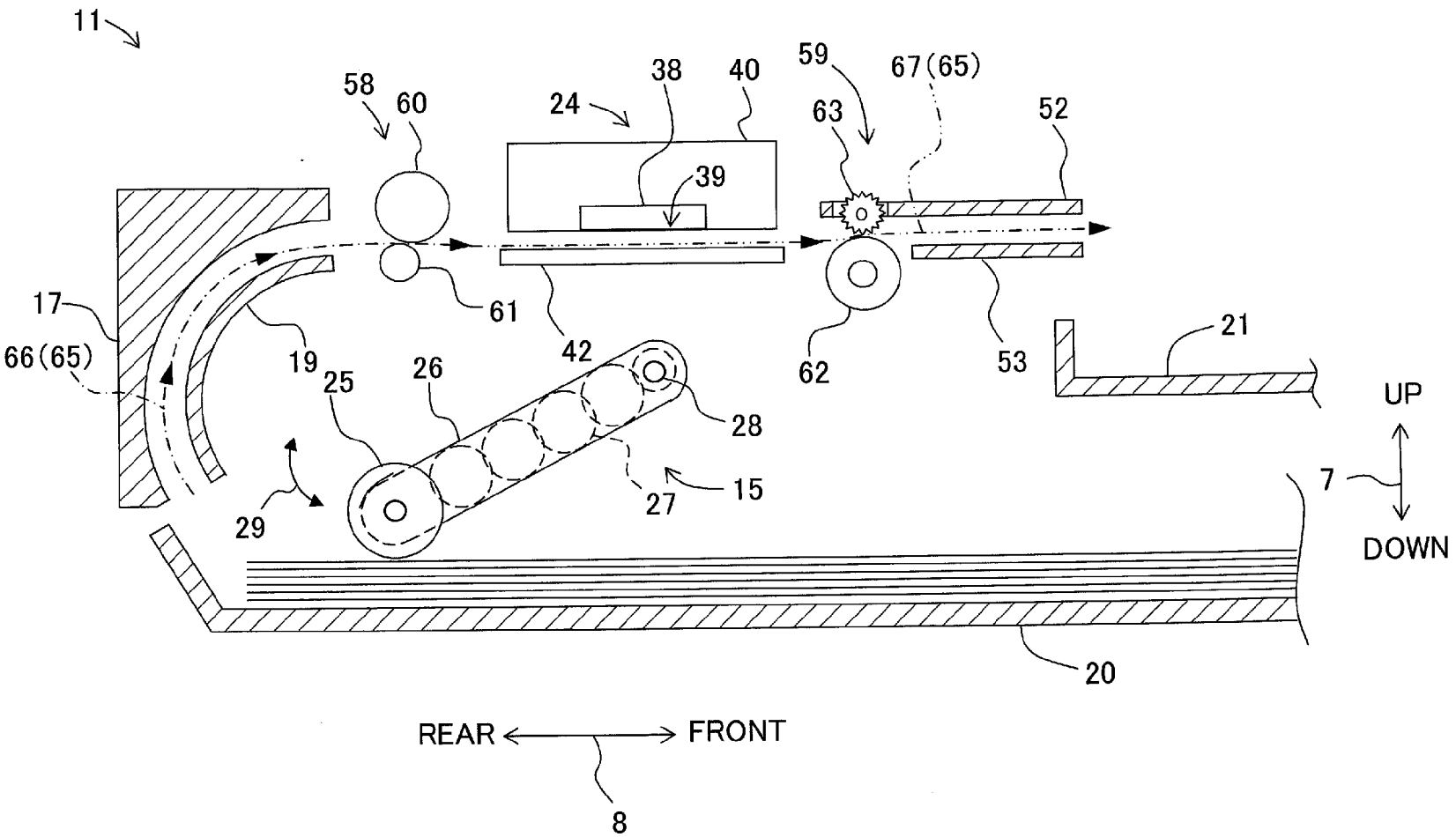
FIG. 2 shows a vertical sectional view schematically illustrating an internal structure of a printer section 11.

As shown in FIG. 2, the printer section 11 is provided with, for example, a paper feed section 15 which feeds the recording paper, and a recording section 24 based on the ink-jet recording system which records an image on the recording paper. The printer section 11 records the image on the recording paper on the basis of, for example, the printing data received from an external apparatus.

<Paper Feed Section 15>

As shown in FIG. 2, the paper feed section 15 is provided over or above the paper feed tray 20. The paper feed section 15 includes a paper feed roller 25, a paper feed arm 26, and a driving force transmission mechanism 27 composed of a plurality of gears meshed with each other. The paper feed roller 25 is rotatably supported by the forward end portion of the paper feed arm 26. The paper feed arm 26 is rotatable in the direction of the arrow 29 about the center of a shaft 28 provided at the proximal portion. Accordingly, the paper feed roller 25 can abut against the paper feed tray 20, and the paper feed roller 25 can be separated from the paper feed tray 20. The paper feed roller 25 is rotated by the driving force of a motor (not shown) transmitted by the driving force transmission mechanism 27. A sheet of the recording paper, which is disposed on the uppermost side and which is included in sheets of the recording paper stacked on the paper feed tray 20, is separated from the other sheets of the recording paper by the paper feed roller 25 in a state in which the paper feed roller 25 is allowed to abut thereagainst, and the sheet of the recording paper is supplied to a curved passage 66 as explained below.

<Transport Passage 65>

As shown in FIG. 2, a transport passage 65, along which the recording paper can be guided, is formed in the printer section 11 over a range ranging from the forward end (end portion disposed on the rear side) of the paper feed tray 20 via the recording section 24 to arrive at the paper discharge tray 21.

The transport passage 65 is divided or comparted into the curved passage 66 which is formed over a range ranging from the forward end of the paper feed tray 20 to arrive at a first roller pair 58 described later on, and a straight passage 67 which is formed over a range ranging from the first roller pair 58 via the position disposed just under the recording section 24 to arrive at the paper discharge tray 21.

The curved passage 66 is a passage which has a curved shape provided to extend from a portion disposed in the vicinity of the forward end of the paper feed tray 20 to the first roller pair 58. The recording paper is guided while being curved in the transport orientation (orientation of the arrow affixed to the alternate long and short dash line shown in FIG. 2) in the transport direction (direction depicted by the alternate long and short dash line shown in FIG. 2) along the curved passage 66. The curved passage 66 is continued to the straight passage 67 with the first roller pair 58 intervening therebetween. Accordingly, the recording paper is guided to the straight passage 67 via the curved passage 66. The curved passage 66 is comparted by an inner guide member 19 and an outer guide member 17 which are opposed to one another while being separated from each other by a predetermined spacing distance.

The straight passage 67 is a passage having a straight shape which is provided to extend in the front-rear direction 8 from the downstream end of the curved passage 66 in the transport direction, i.e., from the first roller pair 58 to the paper discharge tray 21. The recording paper is guided along the straight passage 67 in the transport direction (orientation of the arrow affixed to the alternate long and two short dashes line shown in FIG. 2). The recording paper is discharged to the paper discharge tray 21 after the image is recorded thereon by the recording section 24. The straight passage 67 is formed by the recording section 24 and a platen 42 which are opposed to one another while being separated from each other by a predetermined spacing distance at the portion at which the recording section 24 is provided. The straight passage 67 is comparted by an upper guide member 52 and a lower guide member 53 which are opposed to one another while being separated from each other by a predetermined spacing distance at the portion at which the recording section 24 is not provided.

<Recording Section 24>

As shown in FIG. 2, the recording section 24 is provided over or above the straight passage 67. The recording section 24 is provided with a carriage 40 (example of the movable section of the present invention) which carries a recording head 38 (example of the recording head of the present invention) and which is reciprocatively movable in the main scanning direction, i.e., in the left-right direction 9 (corresponding to the widthwise direction of the present invention) as the direction perpendicular to the paper surface of FIG. 2.

Figure 3:
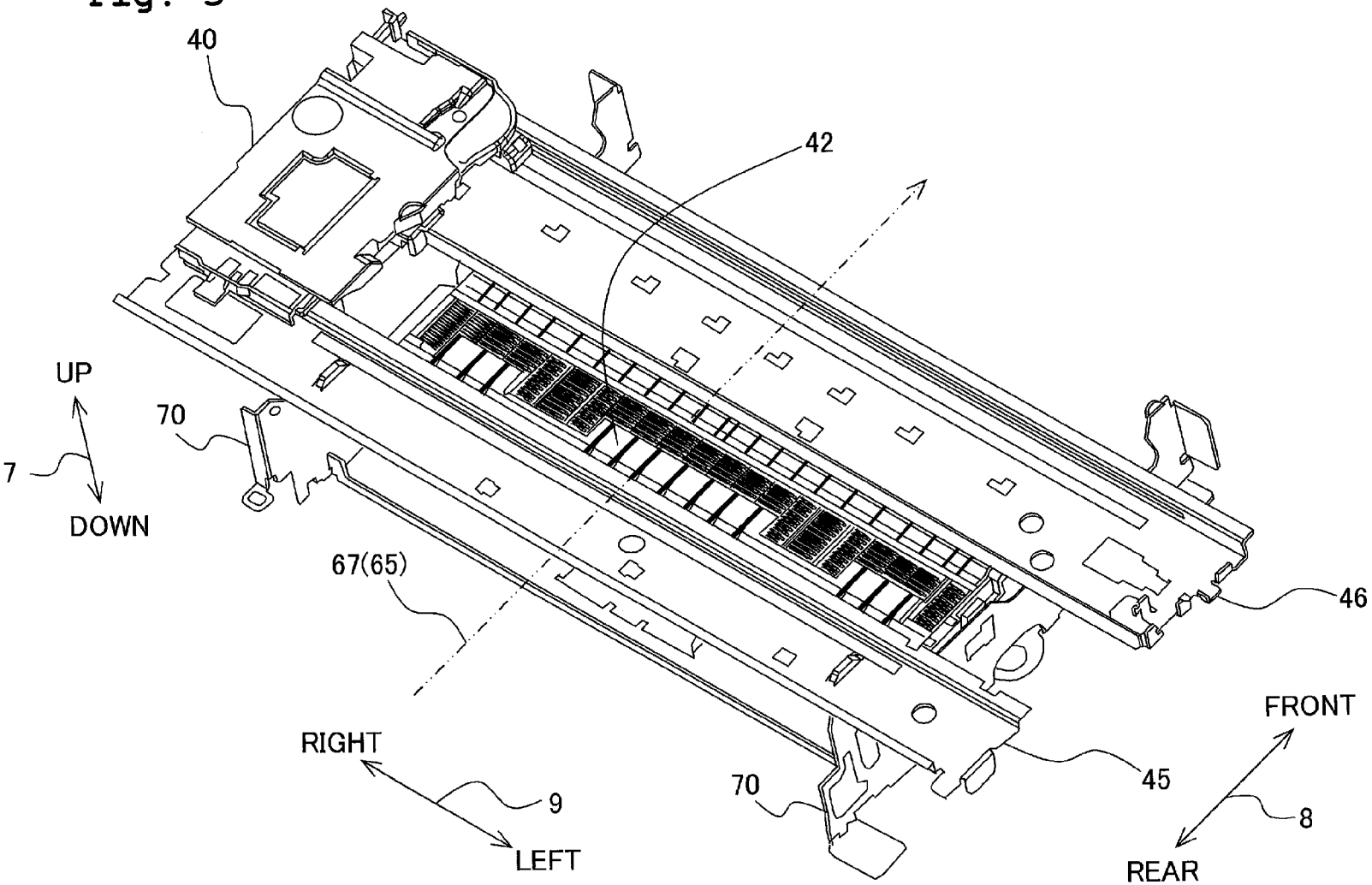
FIG. 3 shows a perspective view illustrating a carriage 40 and a platen 42.

As shown in FIG. 3, the carriage 40 is supported by guide rails 45, 46 which are attached to a frame 70 provided in the printer section 11. In particular, the guide rails 45, 46 are arranged while providing a predetermined spacing distance in the transport orientation of the recording paper. The carriage 40 is provided slidably on the guide rails 45, 46 in the left-right direction 9 (main scanning direction) so that the carriage 40 extends over the guide rails 45, 46.

Inks are supplied from ink cartridges (not shown) to the recording head 38 carried on the carriage 40. As shown in FIG. 2, nozzles 39 (example of the nozzle of the present invention) are formed on the lower surface of the recording head 38. The recording head 38 discharges the inks as minute ink droplets from the nozzles 39. The nozzles 39 discharge the ink droplets toward the platen 42 (example of the platen of the present invention) provided opposingly under or below the straight passage 67 while providing a predetermined spacing distance with respect to the recording section 24. The recording paper, which is transported in the transport orientation, is supported by the platen 42.

According to the arrangement as described above, the carriage 40 is reciprocatively moved in the main scanning direction, while the ink droplets are discharged from the nozzles 39 toward the recording paper transported on the platen 42. Accordingly, the image is recorded on the recording paper. The platen 42 will be described later on.

<First Roller Pair 58 and Second Roller Pair 59>

As shown in FIG. 2, the first roller pair 58, which is composed of a first transport roller 60 arranged on the upper side of the straight passage 67 and a pinch roller 61 arranged opposingly to the first transport roller 60 on the lower side of the straight passage 67, is provided on the upstream side in the transport orientation from the recording section 24 in the straight passage 67. The pinch roller 61 is brought under pressure in contact with the roller surface of the first transport roller 60 by means of an elastic member (not shown) such as a spring or the like. The first roller pair 58 interposes the recording paper so that the recording paper is transported onto the platen 42.

A second roller pair 59, which is composed of a second transport roller 62 arranged on the lower side of the straight passage 67 and a spur 63 arranged opposingly to the second transport roller 62 on the upper side of the straight passage 67, is provided on the downstream side in the transport orientation from the recording section 24 in the straight passage 67. The spur 63 is brought under pressure in contact with the roller surface of the second transport roller 62 by means of an elastic member (not shown) such as a spring or the like. The second roller pair 59 interposes the recording paper allowed to pass through the recording section 24 so that the recording paper is transported to the paper discharge tray 21.

The first transport roller 60 and the second transport roller 62 are rotated by the driving force transmitted from the motor (not shown). When the motor is rotated in one of the forward rotation and the reverse rotation, the first transport roller 60 and the second transport roller 62 transport the recording paper in the transport orientation.

<Platen 42>

As shown in FIG. 2, the platen 42 has the upper surface thereof which is arranged opposingly to the lower surface of the recording head 38. As shown in FIG. 4, the platen 42 generally has a flat plate-shaped form. The platen 42 is arranged while the left-right direction 9 is the longitudinal direction. The platen 42 is provided with first portions 71 (example of the ink-receiving portion (first portion) of the present invention), a second portion 72 (example of the second portion of the present invention), first ribs 74 (example of the first rib of the present invention), and second ribs 85.

Figure 4A:
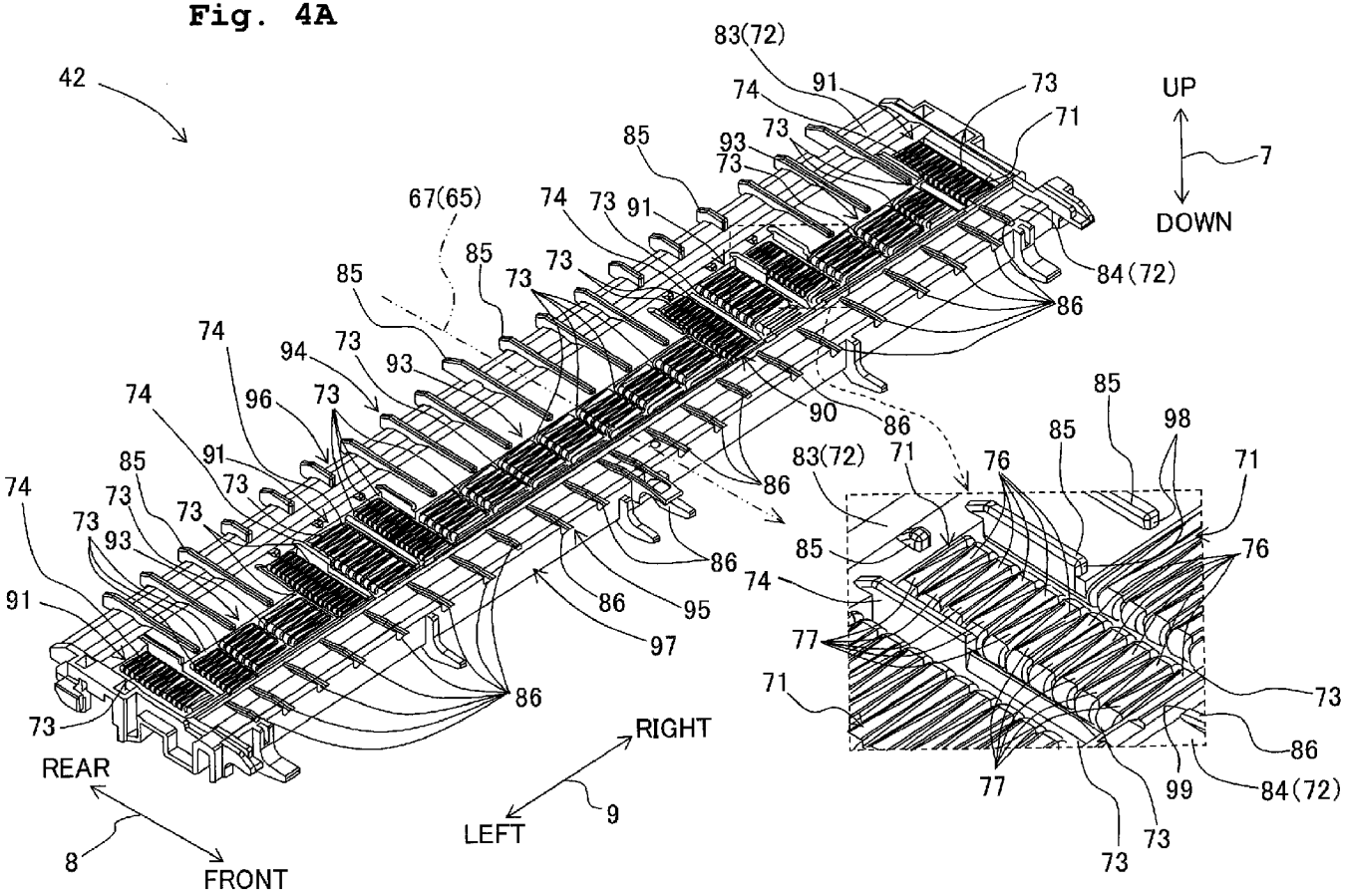
FIGS. 4A and 4B each shows a perspective view illustrating the platen 42 as viewed from an upper position.
Figure 4B:
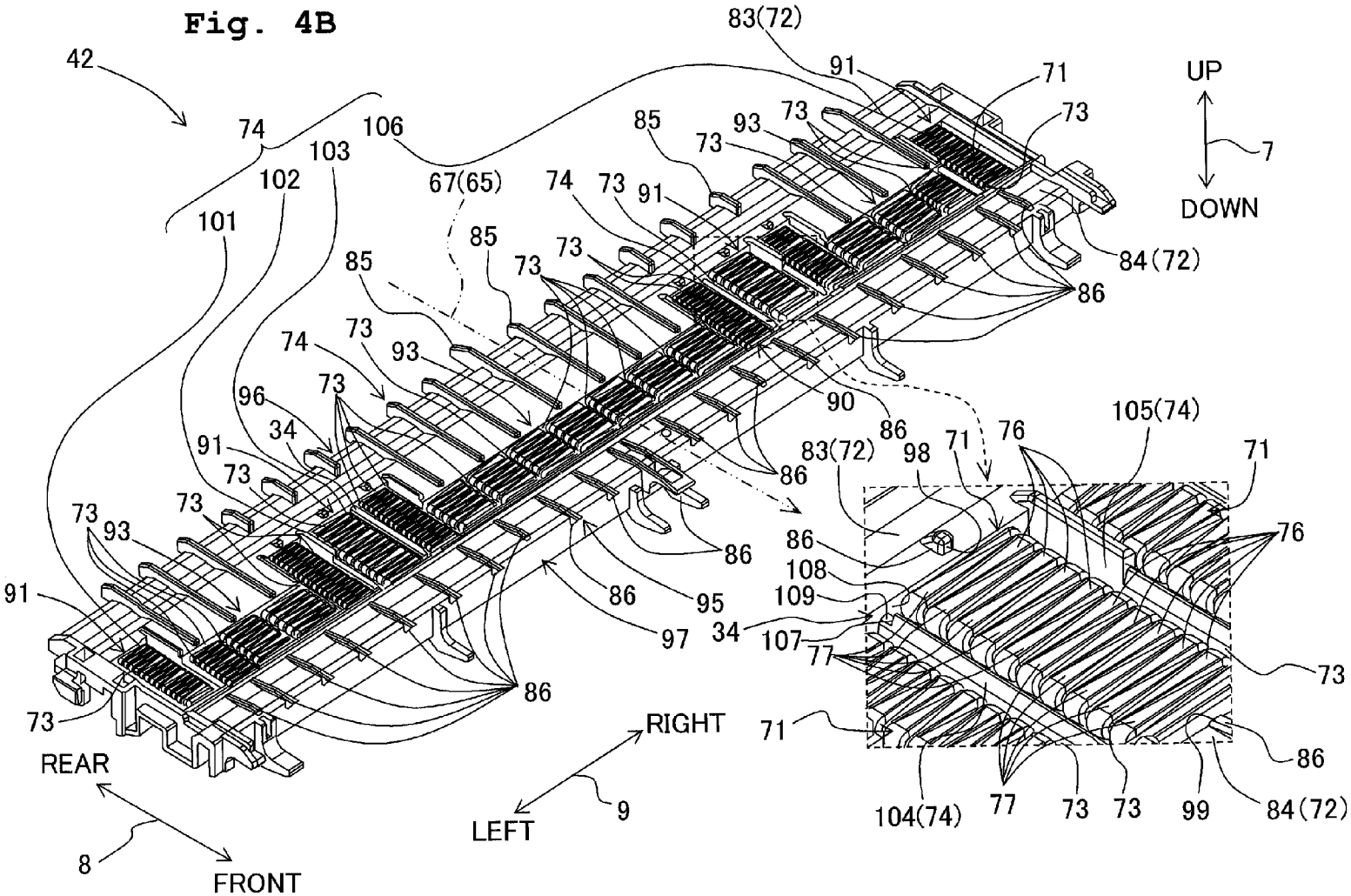

In the following explanation, reference numerals (symbols) in the drawings are partially omitted as follows. In FIGS. 4A to 6 and FIG. 8, some reference numerals are affixed to only those shown in enlarged views, and they are omitted from portions which are not enlarged. In FIGS. 4A and 4B, reference numerals of the second ribs 85 formed on a rear side portion 83 are affixed to only some second ribs 85. In FIG. 6, reference numerals of the third ribs 86 formed on a front side portion 84 are affixed to only some third ribs 86. In FIGS. 4A and 4B, a rear end 94 and a front end 95 are affixed to only one second rib 85 and one third rib 86, and they are omitted from the other second and third ribs 85, 86.

<First Portion 71>

As shown in FIGS. 4A, 4B and 6, the first portion 71 generally has a flat plate-shaped form. A plurality of the first portions 71 are arranged while providing predetermined spacings 73. The respective first portions 71 are provided in one array in the left-right direction 9. In this embodiment, twenty-one first portions 71 are arranged.

The upper surface of the first portion 71 is formed at the position capable of being opposed to the area (hereinafter referred to as "nozzle area") in which the nozzles 39 are arranged on the lower surface of the recording head 38. In particular, the most front end 90 of the upper surface of the first portion 71 is positioned frontwardly as compared with the front end of the nozzle area. Further, the most rear end 91 of the upper surface of the first portion 71 is positioned rearwardly as compared with the rear end of the nozzle area. The right end of the upper surface of the first portion 71 is positioned rightwardly as compared with the right end of the nozzle area provided when the carriage 40 slides to the most right side to which the carriage 40 is slidable during the recording of the image on the recording paper. Further, the left end of the upper surface of the first portion 71 is positioned leftwardly as compared with the left end of the nozzle area provided when the carriage 40 slides to the most left side to which the carriage 40 is slidable during the recording of the image on the recording paper. According to the foregoing description, the upper surface of the first portion 71 corresponds to the landing surface of the present invention on which the ink discharged from the nozzles 39 can be landed. In other words, the landing surface is formed on the first portion 71. The rear ends of the upper surfaces of the first portions 71 are constructed by the most rear end 91 and the rear end 93 disposed frontwardly from the most rear end 91, which will be described later on.

An upper surface ink flow passage, which is composed of first ink flow passages 76 and second ink flow passages 77, is formed on the upper surface of the first portion 71. The upper surface ink flow passage is formed over the entire upper surface of the first portion 71. The first ink flow passages 76 and the second ink flow passages 77 are provided alternately in the front-rear direction 8. In each of the first ink flow passages 76, the highest position is provided at the right end, the width in the front-rear direction 8 is the widest at the right end, the height is lowered at positions disposed more leftwardly, and the width in the front-rear direction 8 is narrowed in accordance therewith. Accordingly, the ink, which is discharged onto the first ink flow passage 76, flows in the leftward direction, and the ink is guided to the left end of the first portion 71, i.e., to the boundary with respect to the spacing 73. In each of the second ink flow passages 77, the highest position is provided at the left end, the width in the front-rear direction 8 is the widest at the left end, the height is lowered at positions disposed more rightwardly, and the width in the front-rear direction 8 is narrowed in accordance therewith. Accordingly, the ink, which is discharged onto the second ink flow passage 77, flows in the rightward direction, and the ink is guided to the spacing 73.

Figure 5:
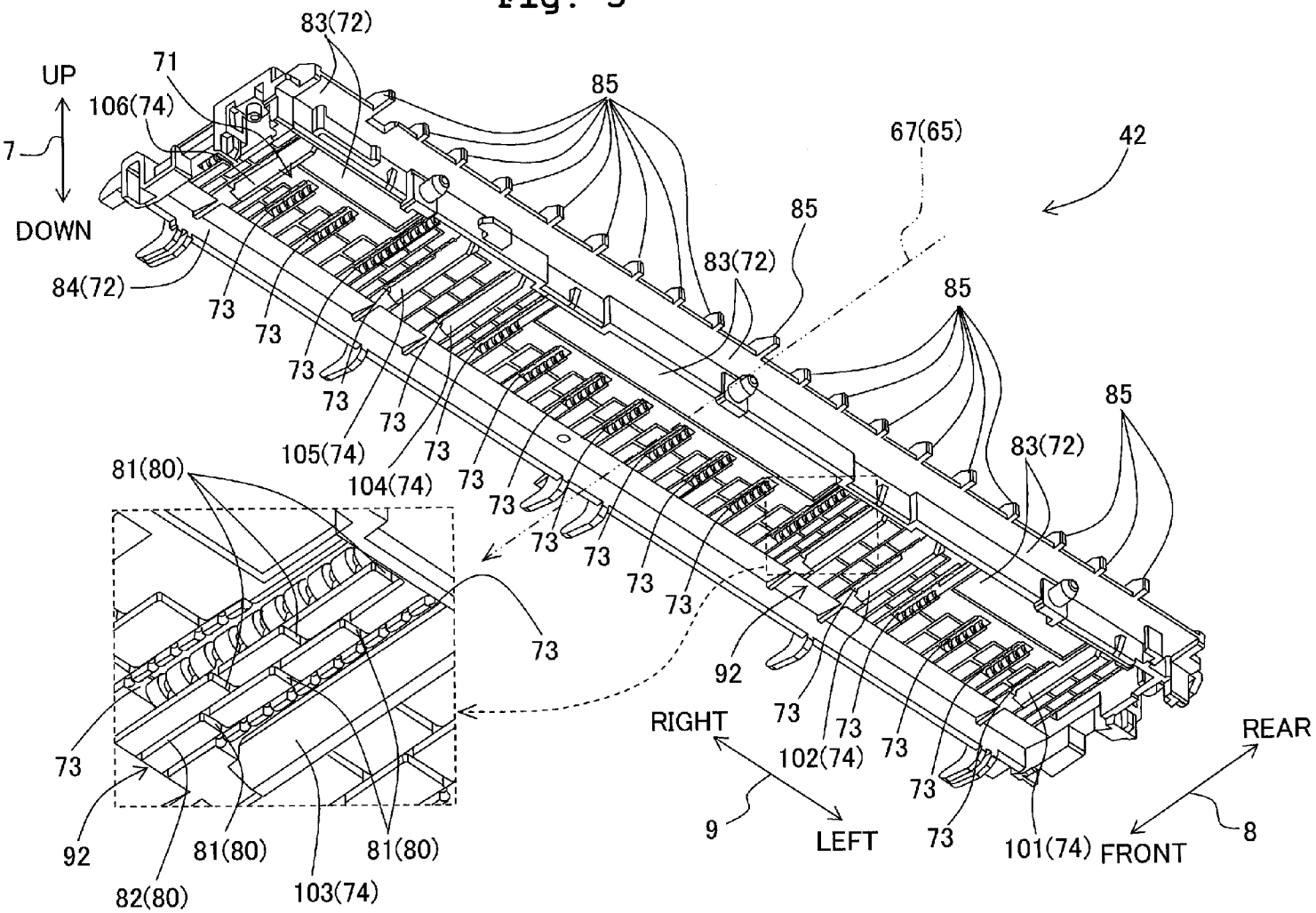
FIG. 5 shows a perspective view illustrating the platen 42 as viewed from a lower position.
Figure 6:
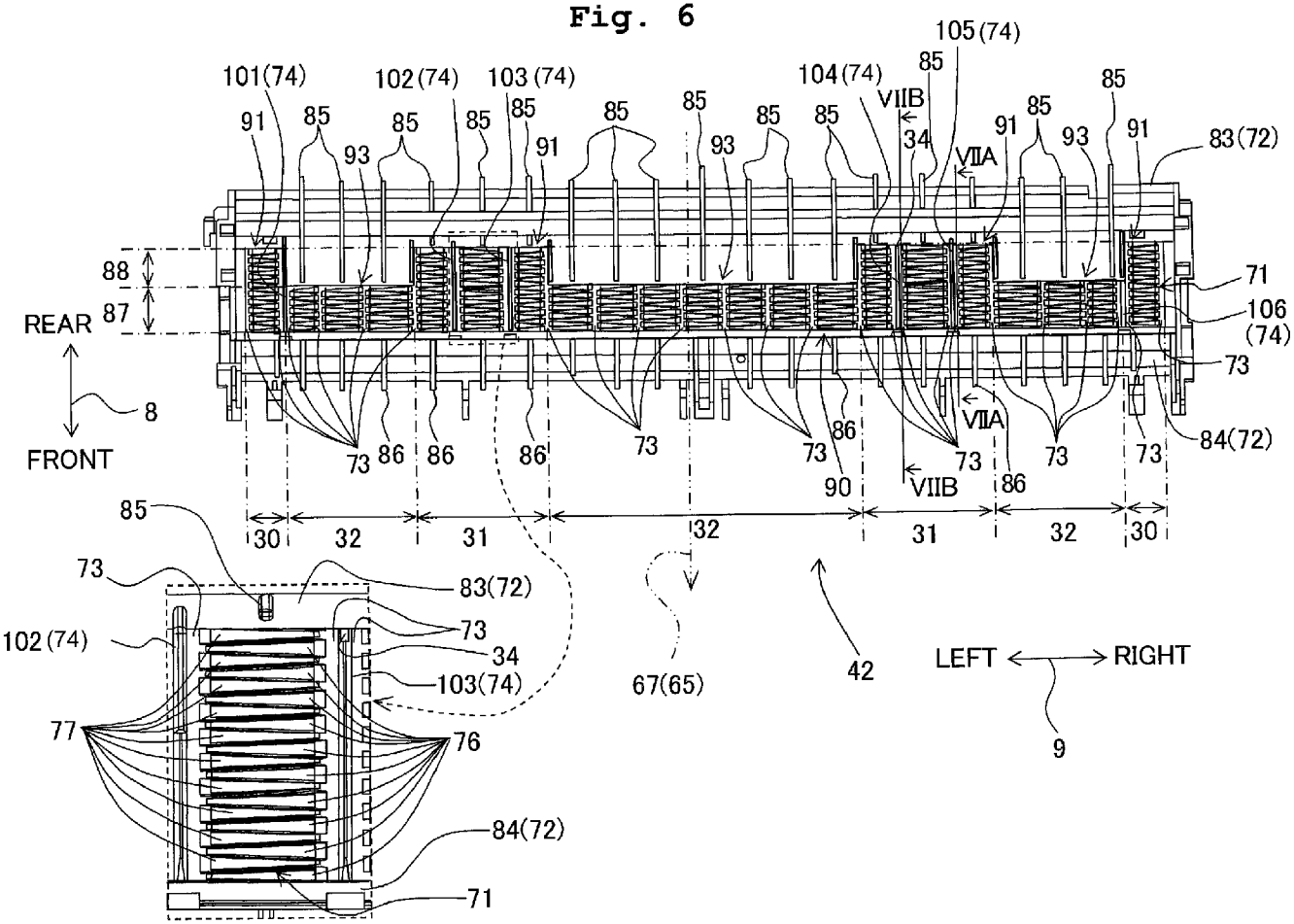
FIG. 6 shows a plan view illustrating the platen 42.
Figure 8:
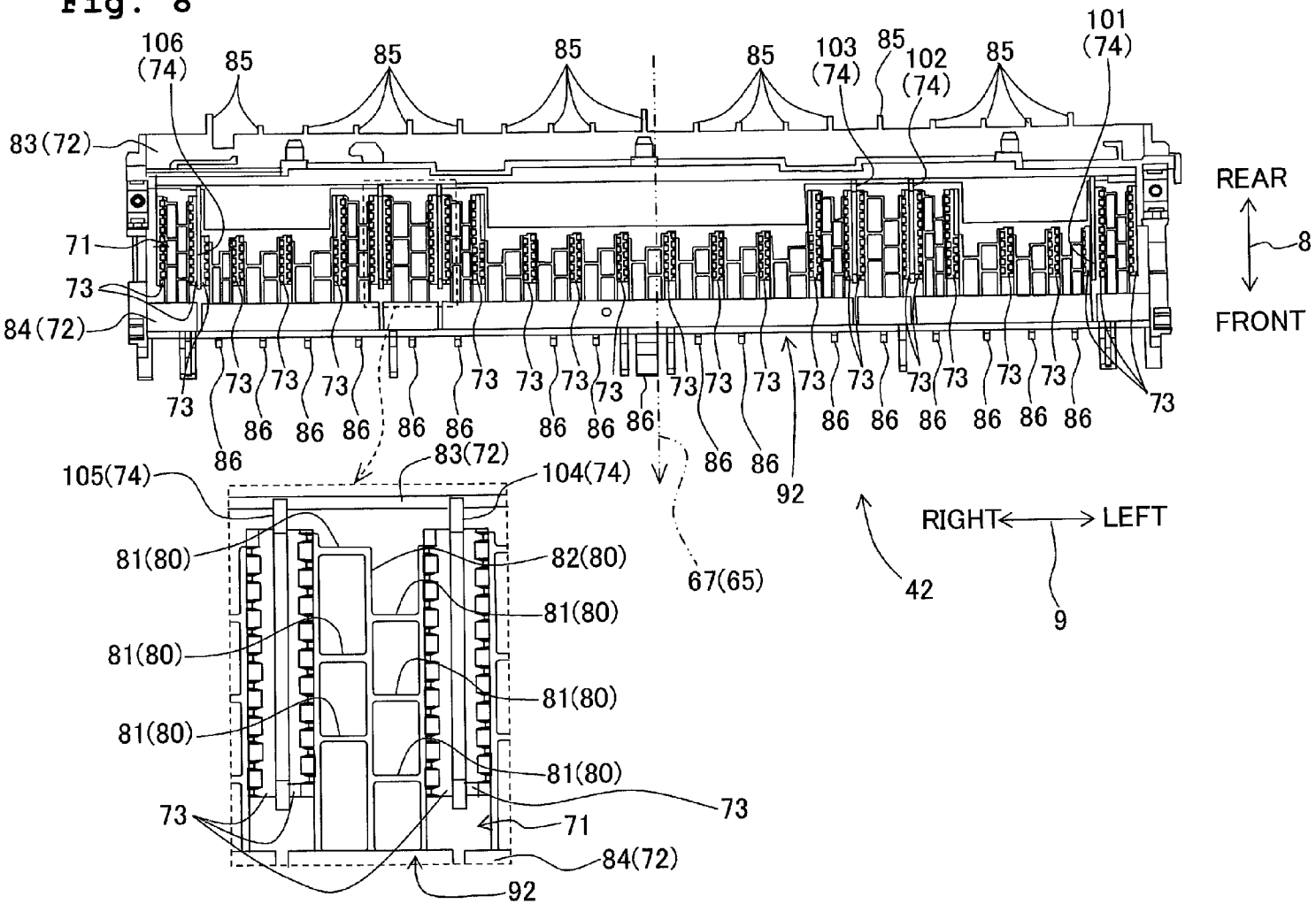
FIG. 8 shows a bottom view illustrating the platen 42.

As shown in FIGS. 5 and 8, a lower surface ink flow passage 80 is formed on the lower surface of the first portion 71. The lower surface ink flow passage 80 is composed of left-right ink flow passages 81 and front-rear ink flow passages 82. The left-right ink flow passage 81 is a groove which is provided to extend in the left-right direction 9 from the edge portions disposed at the left-right ends of the first portion 71. The front-rear ink flow passage 82 has one end which is connected to the left-right ink flow passage 81 and the other end which is provided to extend to the front end 92 of the lower surface of the first portion 71. In this arrangement, an ink-absorbing member (not shown), which is composed of a porous material such as foamed polyurethane or the like, is arranged under or below the second portion 72 provided in front of the first portion 71 (under or below the front side portion 84). The other end of the front-rear ink flow passage 82 is communicated with the ink-absorbing member.

According to the arrangement as described above, the ink, which is discharged onto the upper surface of the first portion 71, flows in the left-right direction 9 along the first ink flow passage 76 or the second ink flow passage 77, and the ink arrives at the left or right end of the first portion 71, i.e., the boundary with respect to the spacing 73. Subsequently, the ink passes along the edge portion of the left or right end from the upper side of the first portion 71, and the ink arrives at the lower side. Finally, the ink flows along the lower surface ink flow passage 80, and the ink arrives at the ink-absorbing member.

<Second Portion 72>

As shown in FIGS. 4A, 4B and 6, the second portion 72 generally has a flat plate-shaped form. The second portion 72 is composed of the rear side portion 83 (example of the upstream side support portion of the present invention) which is arranged on the rear side of the first portion 71, and the front side portion 84 (example of the downstream side support portion of the present invention) which is arranged on the front side of the first portion 71. The rear side portion 83 and the front side portion 84 generally have flat plate-shaped forms. The front end of the rear side portion 83 is formed integrally with the most rear ends 91 and the rear ends 93 of the first portions 71. The rear end of the front side portion 84 is formed integrally with the most front ends 90 of the first portions 71.

In this embodiment, the second portion 72 is composed of the rear side portion 83 and the front side portion 84. However, the second portion 72 may be composed of only the rear side portion 83, or the second portion 72 may be composed of only the front side portion 84.

<Second Rib 85 and Third Rib 86>

As shown in FIGS. 4A, 4B and 6, a plurality of second ribs 85 (example of the second rib of the present invention) are formed on the upper surface of the rear side portion 83. Further, a plurality of third ribs 86 (example of the third rib of the present invention) are formed on the upper surface of the front side portion 84. The respective second ribs 85 and the respective third ribs 86 are allowed to protrude upwardly from the upper surfaces of the rear side portion 83 and the front side portion 84. The respective second ribs 85 and the respective third ribs 86 are provided to extend in the front-rear direction 8. The respective second ribs 85 and the respective third ribs 86 are formed while providing predetermined spacing distances in the left-right direction 9. The plurality of second ribs 85 are capable of supporting the recording paper transported along the straight passage 67 disposed just over the rear side portion 83. The plurality of third ribs 86 are capable of supporting the recording paper transported along the straight passage 67 disposed just over the front side portion 84.

As shown in FIGS. 4A and 4B, the respective rear ends 94 of the second ribs 85 formed on the rear side portion 83 are allowed to protrude to the rear side beyond the rear end 96 of the upper surface of the rear side portion 83. Further, the respective front ends 95 of the third ribs 86 formed on the front side portion 84 are allowed to protrude to the front side beyond the front end 97 of the upper surface of the front side portion 84.

On the other hand, the respective front ends 98 (see the enlarged view in FIGS. 4A and 4B) of the second ribs 85 formed on the rear side portion 83 are provided to extend to merely the positions disposed slightly backwardly from the front end of the upper surface of the rear side portion 83. In other words, the front ends 98 are not brought in contact with the most rear ends 91 and the rear ends 93 of the first portions 71. Further, the respective rear ends 99 (see the enlarged view in FIG. 4) of the third ribs 86 formed on the front side portion 84 are provided to extend to merely the positions disposed slightly frontwardly from the rear end of the upper surface of the front side portion 84. In other words, the rear ends 99 are not brought in contact with the most front ends 90 of the first portions 71.

In this embodiment, the second and third ribs 85, 86 are formed on the upper surface of the second portion 72. However, it is also allowable that the second and third ribs 85, 86 are not formed. In this arrangement, the recording paper is supported by the upper surface of the second portion 72.

<Spacing 73>

As shown in FIGS. 4A to 6 and FIG. 8, a plurality of the spacings 73 are formed in the left-right direction 9 in relation to the upper surfaces of the first portions 71. The right side of the spacing 73 is constructed by the side surface of the left end portion of each of the first portions 71, and the left side of the spacing 73 is constructed by the side surface of the right end portion of each of the first portions 71. The rear side of the spacing 73 is constructed by the side surface for constructing the front end of the rear side portion 83, and the front side of the spacing 73 is constructed by the side surface for constructing the rear end of the front side portion 84.

<First Rib 74>

As shown in FIGS. 4A, 4B and 6, the first rib 74 is provided in at least one of the plurality of spacings 73. In this embodiment, the six first ribs 101 to 106 are provided. The respective first ribs 74 are provided to extend in the front-rear direction 8. The respective rear ends of the first ribs 74 are formed integrally with the rear side portion 83. The respective front ends of the first ribs 74 are formed integrally with the front side portion 84. In other words, the first ribs 74 are provided to extend between the rear side portion 83 and the front side portion 84. Each of the first ribs 74 is provided at the central portion in the left-right direction 9 in the spacing 73. Accordingly, the respective first ribs 74 are separated from the first portions 71 in the left-right direction 9.

As shown in FIGS. 4A, 4B and 6, the positions in the left-right direction 9 of the respective first ribs 74 are different from those of the second ribs 85 and the third ribs 86. In other words, each of the first ribs 74 is arranged between the two second ribs 85 in the left-right direction 9. Further, each of the first ribs 74 is arranged between the two third ribs 86 in the left-right direction 9.

According to the foregoing description, the first ribs 74 are provided within a range of the area constructed by the upper surfaces of the plurality of first portions 71. In other words, the first ribs 74 are provided in a predetermined area including the upper surfaces of the first portions 71.

Figure 7A:
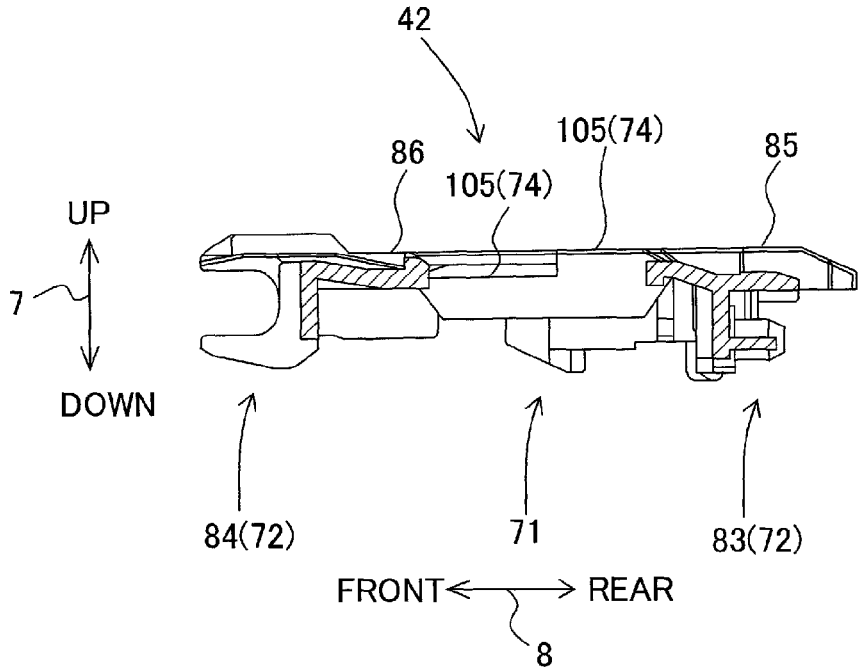
FIG. 7A shows a vertical sectional view taken along VIIA-VIIA line shown in FIG. 6, and FIG. 7B schematically shows a vertical sectional view taken along VIIB-VIIB line shown in FIG. 6.

As shown in FIGS. 4A and 4B, the respective first ribs 74 are allowed to protrude to the upper side beyond the upper surfaces of the first portions 71. In other words, the respective upper ends of the first ribs 74 are disposed at the higher positions as compared with the upper surfaces of the first portions 71. As shown in FIG. 7A, the upper end of each of the first ribs 74 is disposed at the lower position as compared with the upper ends of the second rib 85 and the third rib 86, except for some of the first ribs 74 provided in the second range 88 as described later on (see FIG. 6). In the case of an arrangement in which the second rib 85 and the third rib 86 are not provided, the upper end of each of the first ribs 74 is disposed at the lower position as compared with the upper surface of the second portion 72, except for some of the first ribs 74 provided in the second range 88 as described later on (see FIG. 6). According to the foregoing description, the plurality of first ribs 74 are capable of supporting the recording paper transported along the straight passage 67 disposed just over the first portions 71.

As shown in FIG. 5, the respective first ribs 74 are allowed to protrude to the lower side beyond the lower surfaces of the first portions 71. In other words, the respective lower ends of the first ribs 74 are disposed at the lower positions as compared with the lower surfaces of the first portions 71.

As shown in FIGS. 4A to 6 and FIG. 8, in this embodiment, the first ribs 74 are provided in some of the plurality of spacings 73. However, the first ribs 74 may be provided in all of the spacings 73. In this embodiment, one first rib 74 is provided in each of the spacings 73. However, a plurality of the first ribs 74 may be provided in each of the spacings 73.

In this embodiment, as described above, the front and rear ends of the first rib 74 are formed integrally with the second portion 72 (rear side portion 83 and front side portion 84). However, the first rib 74 may be formed integrally with the rear side portion 83 or the front side portion 84 at one of the front end and the rear end.

<First Range 87 and Second Range 88>

As shown in FIGS. 4 and 6, the first portions 71 are provided to extend backwardly beyond the other portions at least some portions in the left-right direction 9. In particular, as shown in FIG. 6, in this embodiment, the first portions 71 are provided to extend to the most rear ends 91 disposed backwardly as compared with the rear ends 93 in the third ranges 30 disposed at the both end portions in the left-right direction 9 and the fourth ranges 31 disposed between the central portion and the both end portions in the left-right direction 9. On the other hand, the first portions 71 are provided to extend to the rear ends 93 in the fifth ranges 32 other than the third ranges 30 and the fourth ranges 31 in the left-right direction 9.

In other words, the first portions 71 are formed over all of the ranges in the left-right direction 9 (third range 30, fourth range 31, and fifth range 32) in the first range 87 in the front-rear direction 8. On the other hand, the first portions 71 are formed over only some of the ranges in the left-right direction 9 (third range 30 and fourth range 31) in the second range 88 in the front-back direction 8. In this arrangement, as described above, the most rear ends 91 and the rear ends 93 of the first portions 71 are formed integrally with the front end of the rear side portion 83. Accordingly, the second portion 72 is formed in the range in the left-right direction 9 in which the first portions 71 are not formed in the second range 88 in the front-rear direction 8, i.e., in the fifth range 32.

According to the foregoing description, the area formed by the third range 30 and the first range 87 and the second range 88 and the area formed by the fourth range 31 and the first range 87 and the second range 88 correspond to the certain area of the present invention. The area formed by the fifth range 32 and the first range 87 and the second range 88 corresponds to the another area of the present invention. The first portion 71, which is formed in the certain area, has the length in the front-rear direction 8 longer than that of the first portion 71 which is formed in the another area.

As described above, the most rear ends 91 and the rear ends 93 of the first portions 71 are formed integrally with the front end of the rear side portion 83. Accordingly, the rear side portion 83 is formed in the range in the left-right direction 9 in which the first portion 71 is not formed in the second range 88 in the front-rear direction 8, i.e., in the fifth range 32. Specifically, the rear side portion 83 is formed in the area formed by the fifth range 32 and the second range 88.

According to the foregoing description, when the platen 42 is visually recognized in the left orientation from the right end or when the platen 42 is visually recognized in the right orientation from the left end, then the first portion 71 is formed to be superimposed with the rear side portion 83 in the second range 88 in the front-rear direction 8. The ranges in the left-right direction 9, in which the first portion 71 is superimposed with the rear side portion 83 in the second range 88, are the third range 30 and the fourth range 31. In other words, the first portion 71 is formed to be superimposed with the rear side portion 83 and the second rib 86 at least at the parts or portions (third range 30 and fourth range 31) in the left-right direction 9.

In the fourth range 31, the three first portions 71 are provided to extend to the most rear ends 91. Therefore, the spacings 73 formed between the three first portions 71 and the first ribs 102, 103, 104, 105 formed in the spacings 73 are also provided to extend to the most rear ends 91. Therefore, when the platen 42 is visually recognized in the left orientation from the right end or when the platen 42 is visually recognized in the right orientation from the left end, then at least one of the spacings 73 and the first ribs 74 (first ribs 102, 103, 104, 105 in this embodiment) is formed to be superimposed with the rear side portion 83 in the second range 88 in the front-rear direction 8, in the same manner as the first portion 71. In this arrangement, each of the spacings 73 and the first ribs 102, 103, 104, 105 is formed to be superimposed with the rear side portion 83 and the second rib 86 at least at the part or portion (fourth range 31) in the left-right direction 9.

In other words, at least one of the first ribs 74 is formed so that the second portion 72 is positioned in the left-right direction 9.

Further, in other words, the rear side portion 83 is formed at least at the part or portion of the area which corresponds to the another area in the left-right direction 9 (i.e., the third range 30 in the left-right direction 9) and which corresponds to the portion having the longer length of the first portion 71 in the transport direction (i.e., the second range 88 in the front-rear direction 8).

As shown in FIGS. 4A, 4B and FIG. 7A, the upper end of at least one of the first ribs 74 (first ribs 102, 105 in this embodiment) has the height equivalent to that of the upper end of the second rib 85 in the second range 88. Accordingly, as shown in FIG. 6, the plurality of first ribs 74 (first ribs 101 to 106 in this embodiment) can support the recording paper transported along the straight passage 67 disposed just thereover in the first range 87. On the other hand, in the second range 88, the second rib 85 and the first rib 74 (first ribs 102, 105 in this embodiment) having the height equivalent to that of the second rib 85 can support the recording paper transported along the straight passage 67 disposed just thereover.

In the case of any arrangement in which the second rib 85 is not provided, the upper end of at least a part of the first ribs 74 (first ribs 102, 105 in this embodiment) has the height equivalent to that of the upper surface of the second portion 72 in the second range 88. Accordingly, in the first range 87, the plurality of first ribs 74 (first ribs 101 to 106 in this embodiment) can support the recording paper transported along the straight passage 67 disposed just thereover. On the other hand, in the second range 88, the upper surface of the second portion 72 and the first rib 74 (first ribs 102, 105 in this embodiment) having the height equivalent to that of the upper surface of the second portion 72 can support the recording paper transported along the straight passage 67 disposed just thereover.

The foregoing explanation is illustrative of the arrangement in which the first portion 71 is formed to be superimposed with the rear side portion 83. However, it is also allowable that the first portion 71 is formed to be superimposed with the front side portion 84. In other words, it is also allowable that the front side portion 84 is formed in at least a part of the area which corresponds to the another area in the left-right direction 9 and which corresponds to the portion having the longer length of the first portion 71 in the transport direction.

In the fourth range 31, the three first portions 71 are provided to extend to the most rear ends 91. Therefore, the spacings 73 formed between the three first portions 71 and the first ribs 74 formed in the spacings 73 are also provided to extend to the most rear ends 91. Therefore, the first rib 74, which is formed in the certain area, has the length in the front-rear direction 8 longer than that of the first rib 74 which is formed in the another area.

According to the foregoing description, when the platen 42 is visually recognized in the left orientation from the right end or when the platen 42 is visually recognized in the right orientation from the left end, then at least one of the spacings 73 and the first ribs 74 is formed to be superimposed with the rear side portion 83 in the second range 88 in the front-rear direction 8, in the same manner as the first portion 71. In this arrangement, the spacing 73 and the first rib 74 are formed to be superimposed with the rear side portion 83 at least at a part or portion (fourth range 31) in the left-right direction 9.

As shown in FIGS. 4A, 4B, 6, and 7, the upper end of at least one of the first ribs 74 has the height equivalent to that of the upper end of the second rib 85 in the second range 88. In other words, the upper end of at least one of the first ribs 74 provided in the certain area has the same height as that of the upper end of the second rib 85 at the portion at which the rear side portion 83 is formed in the left-right direction 9. When the first portion 71 is formed to be superimposed with the front side portion 84, the upper end of at least one of the first ribs 74 provided in the certain area has the same height as that of the upper end of the third rib 86 at the portion at which the front side portion 84 is formed in the left-right direction 9.

Accordingly, as shown in FIG. 6, the plurality of first ribs 74 can support the recording paper transported along the straight passage 67 disposed just thereover, in the first range 87. On the other hand, in the second range 88, the second rib 85 and the first rib 74 having the height equivalent to that of the second rib 85 can support the recording paper transported along the straight passage 67 disposed just thereover.

The height of the first rib 74 in this embodiment will be explained below more specifically than the above. As shown in FIGS. 4A, 4B and 6, in this embodiment, the six first portions 71, which are provided in the areas formed by the fourth ranges 31 and the first range 87 and the second range 88, i.e., some areas of the certain areas, are provided such that the three first portions 71 are provided on each of the both sides of the rear side portion 83 with respect to the central portion in the left-right direction 9. As shown in FIGS. 4A, 4B and 6, the first ribs 74 (designated as 102, 103, 104, 105 in FIG. 6) are provided respectively in the four spacings 73 formed between the six first portions 71.

The upper ends of the first ribs 103, 104 disposed on the central portion side in the left-right direction 9 of the first ribs 102 to 105 have the heights lower than that of the upper end of the second rib 85 at the portion at which the rear side portion 83 is formed in the left-right direction 9, i.e., in the second range 88. On the other hand, the upper ends of the first ribs 102, 105 disposed on the outer sides in the left-right direction 9 as compared with the first ribs 103, 104 of the first ribs 102 to 105 have the same height as that of the upper end of the second rib 85 at the portion at which the rear side portion 83 is formed in the left-right direction 9, i.e., in the second range 88.

<Recess 34>

As described above, the first rib 74 has the portion superimposed with the second portion 72 and the second rib 85 in the second range 88 (see FIG. 6). As shown in FIGS. 4 and 6, a recess 34 (example of the recess of the present invention) is formed at the boundary portion with respect to the second portion 72 on the upper end of at least one of the first ribs 74 having the superimposed portion. In this embodiment, the recesses 34 are formed on the upper ends of the first ribs 103, 104 of the first ribs 102, 103, 104, 105 superimposed with the rear side portion 83 and the second rib 85 in the second range 88.

In other words, the recesses 34 are formed at the boundary portions with respect to the second portion 72 on the upper ends of the first ribs 103, 104 having the portions at which the second portion 72 is positioned in the left-right direction 9.

The recess 34 is formed by cutting out the upper surface of the rear end of the first rib 103, 104 downwardly. Accordingly, as shown in the enlarged view in FIGS. 4A and 4B, the recess 34 is comparted by two side surfaces (front side surface 107 and rear side surface 108) and one bottom surface 109 (example of the bottom surface of the present invention). In this arrangement, the front side surface 107 is the surface formed by cutting out the first rib 103, 104. The rear side surface 108 is the side surface for constructing the front end of the rear side portion 83.

The depth of the recess 34, i.e., the length in the upward-downward direction 7 of the recess 34 is longer than the length between the upper end of the first rib 103, 104 and the upper surface of the first portion 71. In other words, the bottom surface 109 of the recess 34 is disposed at the lower position as compared with the upper surface of the first portion 71.

As described above, the upper end of each of the first ribs 74 is disposed at the same height as that of the upper end of the second rib 86, or the upper end of each of the first ribs 74 is disposed at the lower position as compared with the upper end of the second rib 86. Therefore, the bottom surface 109 of the recess 34 is disposed at the lower position as compared with the upper end of the second rib 86. Further, as described above, in any arrangement in which the second rib 86 is not provided, the upper end of each of the first ribs 74 has the same height as that of the upper surface of the second portion 72, or the upper end of each of the first ribs 74 is disposed at the lower position as compared with the upper surface of the second portion 72. Therefore, the bottom surface 109 of the recess 34 is disposed at the lower position as compared with the upper surface of the second portion 72.

In this embodiment, the recesses 34 are formed for the first ribs 103, 104. However, the recess 34 may be formed for those other than the first ribs 103, 104, of the first ribs 74 having the superimposed portions as described above. For example, the recesses 34 may be formed for the first ribs 102, 105.

In this embodiment, the first rib 74 has the portion superimposed with the rear side portion 83 of the second portion 72, and the recess 34 is formed at the boundary portion with respect to the rear side portion 83. However, when the first rib 74 has the portion superimposed with the front side portion 84, the recess 34 may be Banned at the boundary portion with respect to the front side portion 84.

Figure 7B:
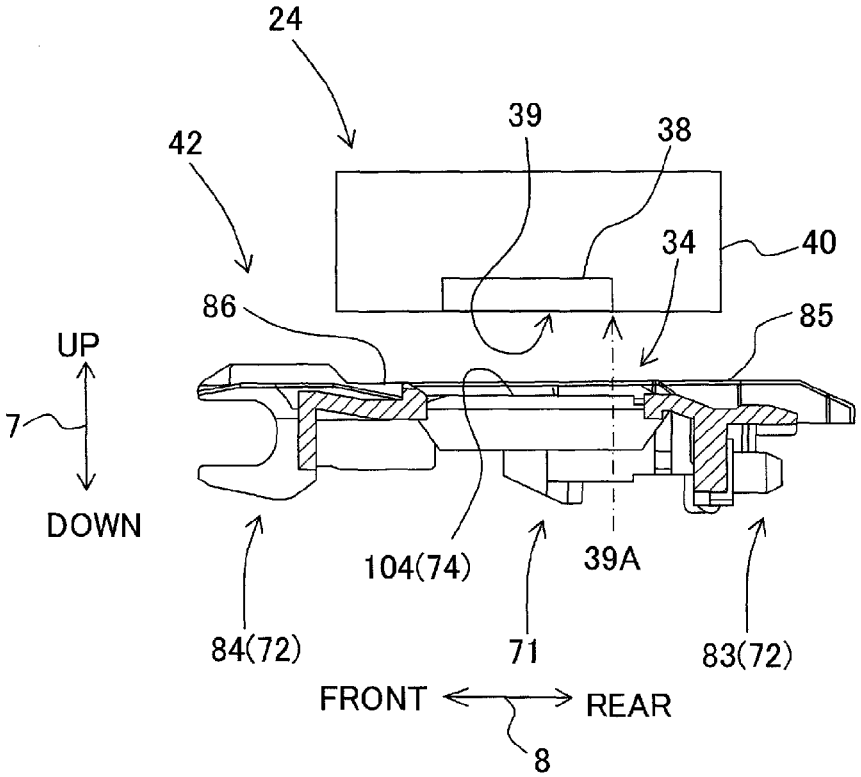

As shown in FIG. 7B, the recess 34, which is formed at the boundary portion with respect to the rear side portion 83, is formed rearwardly or backwardly from the rear end 39A of the nozzle area described above in the front-rear direction 8. When the recess 34 is formed at the boundary portion with respect to the front side portion 84, the recess 34 is formed frontwardly from the front end of the nozzle area in the front-rear direction 8. Accordingly, the position in the front-back direction 8 of the recess 34 is disposed outside the nozzle area irrelevant to the position in the left-right direction 9 of the carriage 40. In other words, the positions in the front-rear direction 8 and the left-right direction 9 of the recess 34 are disposed outside the nozzle area. In other words, the recess 34 is formed outside the area in which the first rib 74 is provided, the area being opposed to the nozzle area. The recess 34, which is formed at the boundary portion with respect to the rear side portion 83, may be formed at the same position as that of the rear end 39A of the nozzle area described above or frontwardly from the rear end 39A in the front-rear direction 8. When the recess 34 is formed at the boundary portion with respect to the front side portion 84, the recess 34 may be formed at the same position as that of the front end of the nozzle area or rearwardly or backwardly from the front end in the front-rear direction 8.

<Effects of Embodiment>

According to the embodiment described above, the first rib 74 is formed in at least one of the spacings 73 of the first portions 71, and the first rib 74 is separated from the first portion 71. Therefore, even when the borderless print is repeatedly executed, and the total amount of the ink adhered to the upper surface of the first portion 71 is increased, then it is possible to prevent the ink from being transferred to the first rib 74. Therefore, it is possible to prevent the ink from being transferred to the top of the first rib 74 in accordance with the capillary phenomenon. According to the foregoing description, the embodiment described above makes it possible to reduce such a possibility that the back surface of the recording paper may be dirtied with the ink, even when the borderless print is repeatedly executed on the recording paper in accordance with the ink-jet recording system.

According to the embodiment described above, the ends in the transport orientation of the first ribs 74 are fixed to the rear side portion 83 and the front side portion 84. Therefore, it is possible to fix the height position of the first rib 74 with respect to the rear side portion 83 and the front side portion 84. Therefore, the height position of the first rib 74, for which the accuracy is required, can be fixed correctly.

In the embodiment described above, the first rib 74 is formed in the spacing 73 between the respective first portions 71. In other words, the position in the transport direction of the first rib 74 is the same as the position of the upper surface of the first portion 71. Therefore, it is feared that the ink droplets, which are discharged from the nozzles 39, may adhere to the first rib 74. However, according to the embodiment described above, when the recording paper is supported by the second ribs 85 or the third ribs 86, the recording paper is not supported by the first ribs 74, unless the recording paper hangs down over or above the upper surfaces of the first portions 71. In other words, in the embodiment described above, any situation, in which the recording paper is supported by the first rib 74, scarcely arises. Therefore, it is possible to lower such a possibility that the ink, which adheres to the first rib 74, may adhere to the back surface of the recording paper.

In the embodiment described above, when the borderless print is executed, the ink is landed on the upper surfaces of the first portions 71. Therefore, the number of the nozzles 39 in the transport orientation capable of simultaneously discharging the ink is restricted to the length of the upper surface of the first portion 71 in the transport direction. In other words, the image recording cannot be executed efficiently on the both side end portions of the transported recording paper. However, in the embodiment described above, the first portions 71 and the first ribs 74, which are disposed in the certain area, have the lengths in the transport direction longer than those of the first portions 71 and the first ribs 74 which are disposed in the another area. Therefore, the number in the transport direction of the nozzles 39 to simultaneously discharge the ink can be increased at the position at which the first portions 71 are lengthened in the transport direction. Accordingly, the image recording on the recording paper can be efficiently executed.

In the embodiment described above, the upper end of the first rib 74 has the same height as that of the upper end of the second rib 85 at the portion at which the rear side portion 83 is formed in the left-right direction 9. Therefore, the recording paper can be also supported by the second rib 84 in addition to the first rib 74 at the portion described above. Accordingly, when the ink is discharged onto the recording paper, the recording paper can be supported more stably.

In the embodiment described above, even when the upper ends of the first ribs 103, 104 disposed on the central portion side are made lower than the upper ends of the second ribs 85, the recording paper can be supported by the rear side portion 83 disposed at the central portion at the position near to the central portion. Further, when the upper ends of the first ribs 102, 105 disposed on the central portion side are made lower than the upper ends of the second ribs 85, even if the ink adheres to the first ribs 103, 104 disposed on the central portion side, then it is possible to lower such a possibility that the ink may adhere to the recording paper.

On the other hand, in the embodiment described above, the upper ends of the first ribs 102, 105 disposed at the positions far from the central portion, i.e., at the positions outside the first ribs 103, 104 disposed on the central portion side have the same height as that of the upper ends of the second ribs 85 disposed at the central portion. Accordingly, the second ribs 85 can support the recording paper at the central portion, and the first ribs 102, 105 can support the recording paper at the positions far from the central portion. As a result, it is possible to stabilize the transport of the recording paper.

According to the embodiment described above, the ink, which is landed on the first rib 74, flows downwardly along the wall surface of the first rib 74. Therefore, even when the ink adheres to the first rib 74, it is possible to lower such a possibility that the ink may adhere to the back surface of the recording paper.

When the first portions 71 are formed integrally with the rear side portion 83 or the front side portion 84, it is feared that the ink, which is landed on the upper surfaces of the first portions 71, may flow in the transport orientation or in the orientation opposite to the transport direction, and the ink may arrive at the rear side portion 83 or the front side portion 84. As a result, the rear side portion 83 or the front side portion 84, on which the ink is not landed in the ordinary situation, is dirtied by the ink. Further, it is feared that the ink, which arrives at the rear side portion 84 or the front side portion 84, may be moved upwardly along the wall surface of the second rib 85 or the third rib 86 in accordance with the capillary phenomenon. As a result, it is feared that the ink may adhere to the back surface of the recording paper supported by the second rib 85 or the third rib 86, and the recording paper may be dirtied. However, in the embodiment described above, the ink, which is landed on the upper surfaces of the first portions 71, flows in the left-right direction 9 along the first ink flow passages 76 and the second ink flow passages 77, and the ink is introduced into the spacings 73. Therefore, it is possible to avoid the occurrence of the problem as described above.

In the embodiment described above, the first ribs 74 are arranged between the second ribs 85 and between the third ribs 86 in the left-right direction 9. Accordingly, it is possible to increase the area in the left-right direction 9 for supporting the recording paper. As a result, it is possible to stabilize the transport of the recording paper.

According to the embodiment described above, the ink, which is landed in the vicinity of the boundary portion between the first rib 74 and the second portion 72, stays in the recess 34. Accordingly, the distance of upward movement, which is required for the ink to arrive at the second portion 72 from the recess 34 in accordance with the capillary phenomenon, is lengthened. Therefore, it is possible to lower such a possibility that the ink may be moved from the first rib 74 to the second portion 72 and the second and third ribs 85, 86 in accordance with the capillary phenomenon. Therefore, even when the borderless print is executed on the recording paper in accordance with the ink-jet recording system, it is possible to lower such a possibility that the back surface of the recording paper may be dirtied by the ink. Further, it is possible to lower such a possibility that the second portion 72, to which the ink does not adhere originally, may be dirtied by the ink.

When the recess 34 is formed on the first rib 74, it is feared that the forward end of the recording paper may enter the recess 34. However, in this embodiment, the recess 34 is formed at the boundary portion with respect to the second portion 72 at the upper end of the first rib 74 having the portion at which the second portion 72 is positioned in the left-right direction 9. Accordingly, the recording paper is supported by the second and third ribs 85, 86 at the position at which the recess 34 is formed. Therefore, it is possible to prevent the forward end of the recording paper from entering the recess 34.

The first rib 74 is formed in the predetermined area including the upper surface of the first portion 71. Therefore, it is feared that the ink droplets, which are discharged from the nozzles 39, may adhere to the first rib 74. However, according to this embodiment, when the recording paper is supported by the second and third ribs 85, 86, the recording paper is not supported by the first rib 74. In other words, in this embodiment, any situation, in which the recording paper is supported by the first rib 74, scarcely arises. Therefore, it is possible to lower such a possibility that the ink, which adheres to the first rib 74, may adhere to the back surface of the recording paper.

When the borderless print is repeatedly executed, the total amount of the ink adhered to the upper surface of the first portion 71 is increased. In such a situation, it is feared that the ink may be moved upwardly from the upper surface of the first portion 71 along the wall surface of the first rib 74 to the top of the first rib 74 in accordance with the capillary phenomenon. If the upward movement arises, then the ink adheres to the back surface of the recording paper which is transported subsequently and which is supported by the first rib 74, and the recording paper is dirtied. However, according to the embodiment described above, the first rib 74 is formed in the spacing 73 between the first portions 71. Therefore, the first rib 74 is separated from the first portion 71. Therefore, even when the borderless print is repeatedly executed, and the total amount of the ink landed on the upper surface of the first portion 71 is increased, then it is possible to prevent the ink from being transferred to the first rib 74. Therefore, it is possible to prevent the ink from being transferred to the top of the first rib 74 in accordance with the capillary phenomenon.

According to the embodiment described above, the position of the first rib 74 can be fixed by the second portion 72. Therefore, the height position of the first rib 74, for which the accuracy is required, can be correctly fixed.

According to the embodiment described above, the recess 34 is formed to be deeper than the upper surface of the first portion 71. Therefore, it is possible to further lengthen the distance of upward movement required for the ink allowed to stay in the recess 34 to arrive at the second portion 72.

According to the embodiment described above, the first rib 74 protrudes to the lower side beyond the lower surface of the first portion 71. Therefore, the recess 34 can be formed more deeply on the first rib 74. Therefore, it is possible to further lengthen the distance of upward movement required for the ink allowed to stay in the recess 34 to arrive at the second portion 72. Further, it is possible to increase the areal size of the boundary portion between the first rib 74 and the second portion 74. Accordingly, it is possible to strengthen the attachment strength of the boundary portion.

According to the embodiment described above, the recess 34 is formed outside the area opposed to the nozzle area. Therefore, the ink is not landed directly on the recess 34. Therefore, the ink is hardly pooled in the recess 34. Therefore, it is possible to lower such a possibility that the ink may be moved from the first rib 74 to the second portion 72 and/or the second and third ribs 85, 86 in accordance with the capillary phenomenon.

First Modified Embodiment

A water-repelling treatment may be applied to the bottom surface 109 of the recess 34. For example, the bottom surface 109 may be subjected to the coating with a substance having the high water-repelling performance such as fluorine or the like. In another example, minute irregularities may be provided on the bottom surface 109. The two examples described above may be combined with each other. In other words, the bottom surface 109, on which the minute irregularities are provided, may be subjected to the coating with fluorine or the like.

According to the first modified embodiment, the ink hardly adheres to the bottom surface 109 of the recess 34. Therefore, it is possible to lower such a possibility that the ink may be moved from the first rib 74 to the second portion 72 and/or the second rib 86 in accordance with the capillary phenomenon.

Second Modified Embodiment

The bottom surface 109 of the recess 34 may be composed of at least one inclined surface (example of the inclined surface of the present invention) in which the surface is inclined so that a central portion in the left-right direction 9 is higher than both end portions in the left-right direction 9.

Figure 9A:
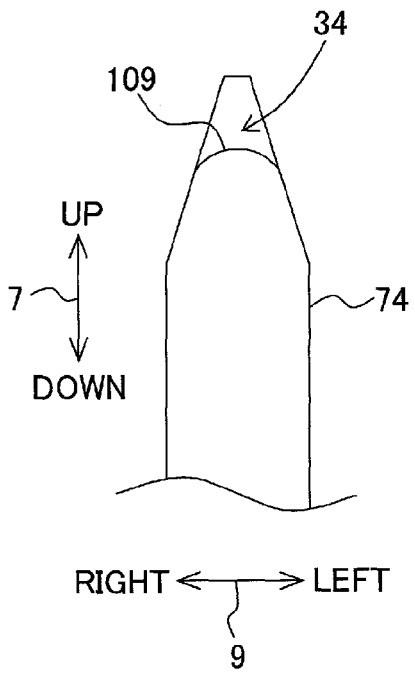
FIG. 9A shows a front view illustrating a recess 34 in a first example of a second modified embodiment.

In a first example, as shown in FIG. 9A, the bottom surface 109, which is provided as the inclined surface of the present invention, may be inclined downwardly while being curved from a central portion in the left-right direction 9 to both end portions.

Figure 9B:
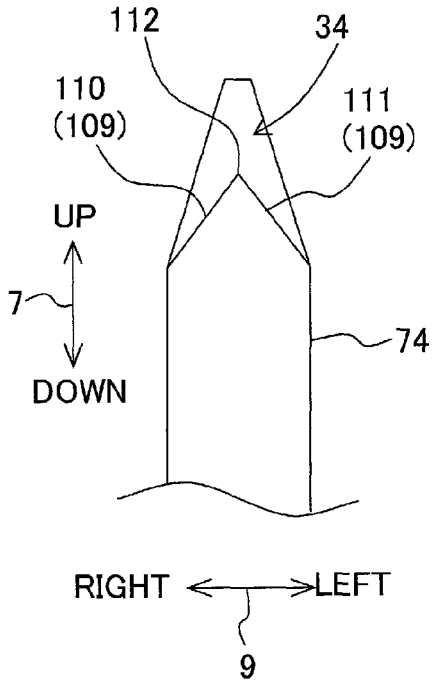
FIG. 9B shows a front view illustrating a recess 34 in a second example of the second modified embodiment.

In a second example, as shown in FIG. 9B, the bottom surface 109 may have such a shape that the bottom surface 109 is sharpened at a central portion in the left-right direction 9. In other words, the bottom surface 109 may be composed of a first inclined surface 110 (example of the inclined surface of the present invention) which is directed obliquely rightwardly in the downward direction from a forward end 112 disposed at the central portion in the left-right direction 9 and a second inclined surface 111 (example of the inclined surface of the present invention) which is directed obliquely leftwardly in the downward direction from the forward end 112.

Figure 9C:
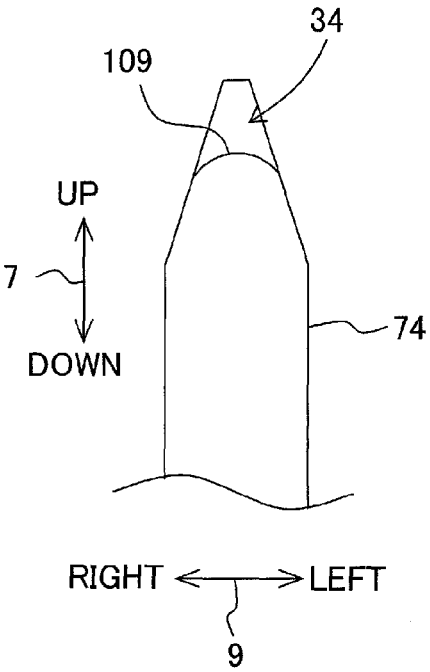
FIG. 9C shows a front view illustrating a recess 34 in a third example of the second modified embodiment.
Figure 9D:
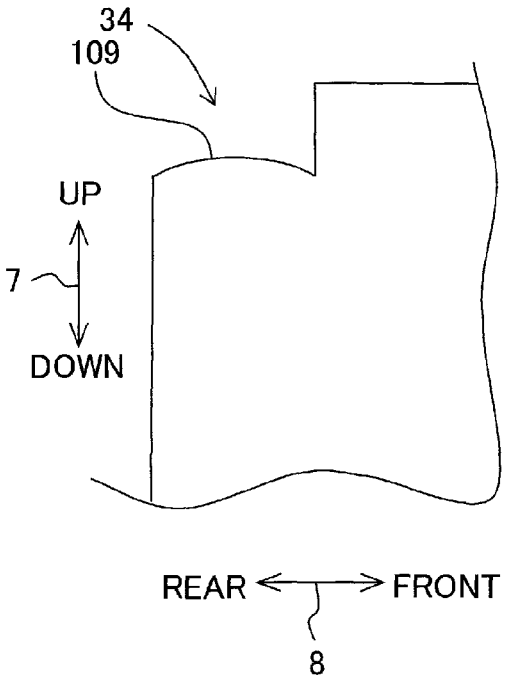
FIG. 9D shows a left side view illustrating the recess 34 in the third example of the second modified embodiment.

In a third example, as shown in FIGS. 9C and 9D, the bottom surface 109, which is provided as the inclined surface of the present invention, may be composed of a spherical surface.

According to the second modified embodiment, the ink is easily introduced along the inclination from the bottom surface 109 of the recess 34 to the both ends of the first rib 74. Therefore, it is possible to lower such a possibility that the ink may be moved from the first rib 74 to the second portion 72 and/or the second rib 86 in accordance with the capillary phenomenon.

Third Modified Embodiment

Figure 10:
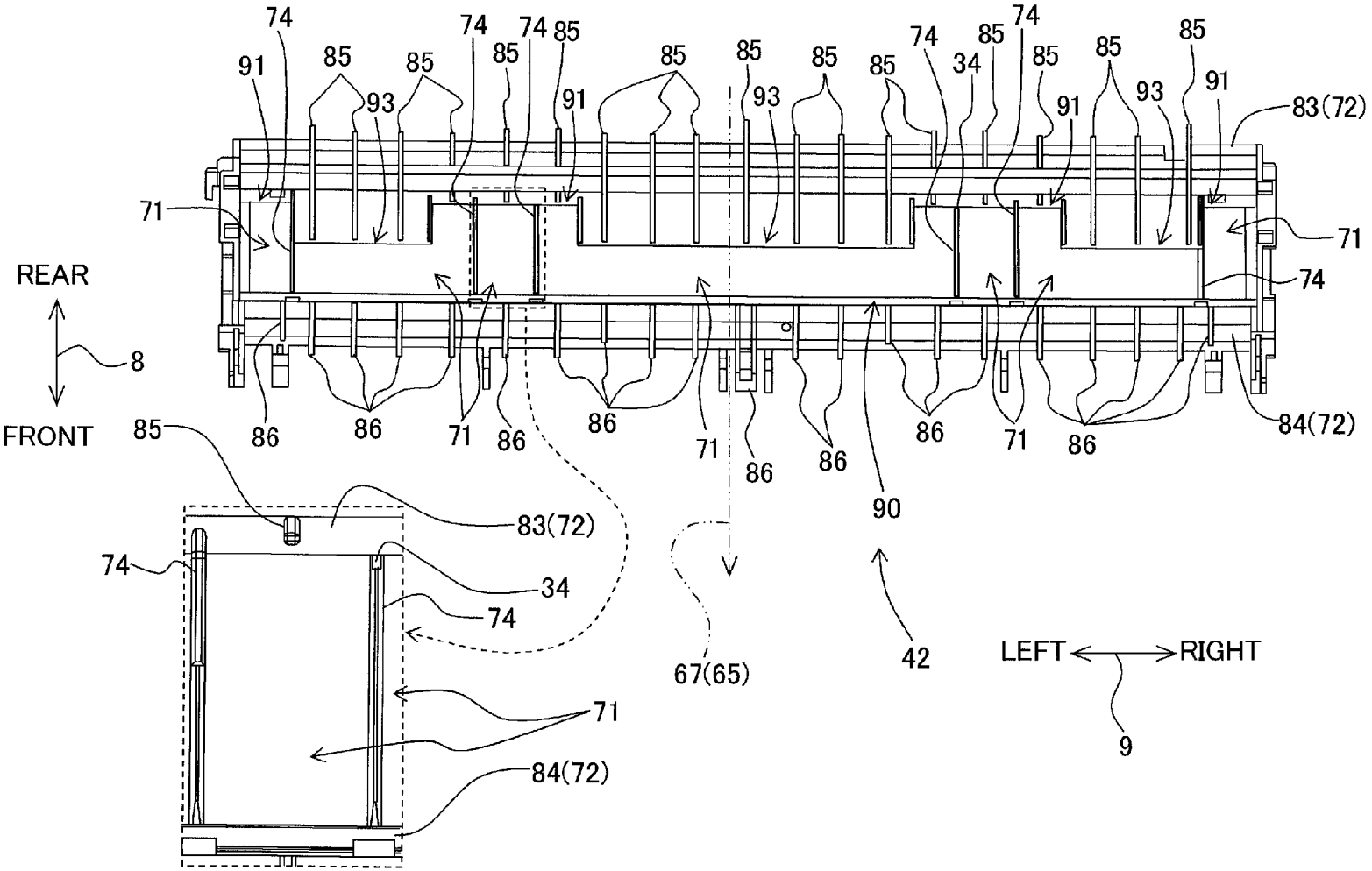
FIG. 10 shows a plan view illustrating a platen 42 in a third modified embodiment.

The embodiment described above is illustrative of the arrangement in which the plurality of the first portions 71 are arranged while providing the predetermined spacings 73, and the first ribs 74 are provided in the spacings 73 as shown in FIG. 6. However, as shown in FIG. 10, a first portion 71 may be arranged singly without providing any predetermined spacing 73, and first ribs 74 may be provided upstandingly from an upper surface of the first portion 71. Also in the case of the arrangement shown in FIG. 10, the first ribs 74 have portions superimposed with the second portion 72 and the second ribs 85, in the same manner as in the arrangement shown in FIG. 6. Further, a recess 34 is formed at a boundary portion with respect to the second portion 72 on an upper end of at least one of the first ribs 74 having the superimposed portions as described above.

What is claimed is:

1. A platen which supports a recording medium transported in a transport direction and which is arranged opposingly under a recording head having nozzles through which droplets of an ink are discharged, the platen comprising:

a first portion which is formed with a landing surface on which the ink discharged from the nozzles is landed;

a first rib which extends in the transport direction in a predetermined area including the landing surface, which protrudes to an upper side beyond the landing surface, and which supports the recording medium; and a second portion which is provided on at least one of an upstream side and a downstream side in the transport direction as compared with the first portion and which supports the recording medium;

wherein the first portion is formed as a plurality of the first portions which are arranged in a widthwise direction, that is perpendicular to the transport direction and extends along the landing surface, so that an opening that extends from the upper side of the first portion to a lower side of the first portion is formed between two adjacent first portions of the first portions in the widthwise direction; and the first rib is separated from the first portions by the opening in the widthwise direction.

2. The platen according to claim 1, wherein the first rib is formed as a plurality of first ribs, and a recess, which has a bottom surface that is lower than an upper surface of the second portion, is formed at a boundary portion with respect to the second portion, on an upper end of at least one of the first ribs.

3. The platen according to claim 2, wherein at least one of the first ribs is formed so that the second portion is positioned in the widthwise direction; and the recess is formed at the boundary portion with respect to the second portion on the upper end of the first rib having a portion at which the second portion is positioned in the widthwise direction.

4. The platen according to claim 2, wherein the upper end of the first rib is lower than an upper end of the second portion.

5. The platen according to claim 2, wherein the first ribs are formed integrally with the second portion.

6. The platen according to claim 2, wherein the bottom surface of the recess is disposed at a position lower than the landing surface.

7. The platen according to claim 2, wherein the first rib protrudes to a lower side beyond a lower surface of the first portion.

8. The platen according to claim 2, wherein a water-repelling treatment is applied to the bottom surface of the recess.

9. The platen according to claim 2, wherein the bottom surface of the recess includes at least one inclined surface which is inclined so that a central portion in a widthwise direction is higher than both end portions in the widthwise direction.

10. An image recording apparatus comprising: the platen as defined in claim 2;

a movable section which is arranged opposingly above the platen while providing a predetermined spacing distance with respect to the platen and which is reciprocatively movable in a widthwise direction that is perpendicular to the transport direction and that extends along the landing surface; and a recording head which is provided on the movable section and in which nozzles through which the ink droplets are discharged toward the platen are formed.

11. The image recording apparatus according to claim 10, wherein the recess is formed outside an area opposed to an area in which the nozzles are arranged on the recording head.

12. The platen according to claim 1, wherein the first portion is formed as a plurality of ink-receiving portions which are arranged in the widthwise direction so that an opening is formed between two adjacent ink-receiving portions of the ink-receiving portions in the widthwise direction, the second portion includes an upstream side support portion which is provided on an upstream side in the transport direction as compared with the ink-receiving portions and which supports the recording medium, and a downstream side support portion which is provided on a downstream side in the transport direction as compared with the ink-receiving portions and which supports the recording medium; and the first rib is separated from the ink-receiving portions in the widthwise direction by the opening between the two adjacent ink-receiving portions of the ink-receiving portions, and the first rib extends between the upstream side support portion and the downstream side support portion in the transport direction, and protrudes to the upper side beyond the landing surface to support the recording medium.

13. The platen according to claim 12, wherein at least one of an upstream side portion and a downstream side portion in the transport direction of the first rib is formed integrally with at least one of the upstream side support portion and the downstream side support portion, respectively.

14. The platen according to claim 12, wherein a plurality of second ribs extending in the transport direction are formed on an upper surface of the upstream side support portion;

a plurality of third ribs extending in the transport direction are formed on an upper surface of the downstream side support portion; and an upper end of the first rib is lower than upper ends of the second rib and the third rib.

15. The platen according to claim 14, wherein the first rib is formed as a plurality of first ribs, a part of the ink-receiving portions and the first ribs, which are disposed in a certain area of areas provided with the ink-receiving portions and the first ribs, is formed to have lengths in the transport direction longer than those of a residual part of the ink-receiving portions and the first ribs which are disposed in another area;

the upstream side support portion or the downstream side support portion is formed to be positioned in at least a part of an area which corresponds to the another area in the widthwise direction and which corresponds to a portion at which the landing surface is formed to be long in the transport direction; and the upper end of at least one of the first ribs provided in the certain area has the same height as that of the upper end of the second rib or the third rib at a portion at which the upstream side support portion or the downstream side support portion is formed in the widthwise direction.

16. The platen according to claim 15, wherein the part of the ink-receiving portions, which are disposed in the certain area, are provided on both sides of the upstream side support portion or the downstream side support portion at a central portion in the widthwise direction;

an upper end of a first rib of the first ribs disposed on a side of the central portion, which relates to the part of the ink-receiving portion provided in the certain area, has a height lower than that of the upper end of the second rib or the third rib at a portion at which the upstream side support portion or the downstream side support portion is formed in the widthwise direction; and an upper end of another first rib of the first ribs disposed outside the first rib arranged on the side of the central portion, which relates to the part of the ink-receiving portions provided in the certain area, has the same height as that of the upper end of the second rib or the third rib at the portion at which the upstream side support portion or the downstream side support portion is formed in the widthwise direction.

17. The platen according to claim 12, wherein the first rib protrudes to a lower side beyond a lower surface of the ink-receiving portions.

18. The platen according to claim 12, wherein the landing surface is formed with an ink flow passage which allows the landed ink to flow in the widthwise direction.

19. The platen according to claim 12, wherein the first rib is formed as a plurality of first ribs, and the first ribs are arranged between the second ribs and between the third ribs in the widthwise direction.

20. An image recording apparatus comprising:

the platen as defined in claim 12;

a movable section which is arranged opposingly above the platen while providing a predetermined spacing distance with respect to the platen and which is reciprocatively movable in a widthwise direction that is perpendicular to the transport direction and that extends along the landing surface; and a recording head which is provided on the movable section and in which nozzles through which the ink droplets are discharged toward the platen are formed.

* * * * *